United States Patent [19]

Fenn et al.

[11] Patent Number: 4,819,330

[45] Date of Patent: Apr. 11, 1989

[54] LIVE-ACTION BLADE SHAVER

[76] Inventors: Lawrence E. Fenn, 101 Landsdowne, Westport, Conn. 06880; Leo Chateauneuf, 16 Russ Rd., Trumbull, Conn. 06611

[21] Appl. No.: 104,502

[22] Filed: Oct. 5, 1987

[51] Int. Cl.[4] ..... B26B 19/28

[52] U.S. Cl. ..... 30/45; 30/44

[58] Field of Search ..... 30/45, 217, 218, 219, 30/43, 44, 42, 43.92, 43.91

[56] References Cited

U.S. PATENT DOCUMENTS

| | | | |
|---|---|---|---|
| 860,849 | 7/1907 | Bradshaw | 30/44 |
| 1,663,809 | 3/1928 | Moon | 30/45 |
| 1,798,831 | 3/1931 | Brazeal | 30/44 |
| 2,054,418 | 9/1936 | Böhm | 30/45 |
| 2,319,815 | 5/1943 | Harshberger | 30/44 |
| 2,609,602 | 9/1952 | Harshberger | 30/45 |
| 3,324,545 | 6/1967 | Sali | 30/45 |
| 3,587,174 | 6/1971 | Nissen | 30/346.5 |
| 3,611,568 | 10/1971 | Alexander et al. | 30/45 |
| 3,636,627 | 1/1972 | Tiffin | 30/45 |
| 3,753,846 | 8/1973 | Trouilhet | 161/111 |
| 3,772,779 | 11/1973 | Douglas et al. | 30/45 |
| 3,872,587 | 3/1975 | Wellinger | 30/43.92 |
| 4,433,483 | 2/1984 | Lazarus | 30/41 |
| 4,512,077 | 4/1985 | Tanabe et al. | 30/77 X |
| 4,549,352 | 10/1985 | Ochiai et al. | 30/43.92 X |
| 4,642,892 | 2/1987 | Ishida | 30/44 |
| 4,744,144 | 5/1988 | Lowery, Sr. et al. | 30/45 |

FOREIGN PATENT DOCUMENTS

| | | | |
|---|---|---|---|
| 0335526 | 4/1921 | Fed. Rep. of Germany | 30/45 |

*Primary Examiner*—Eugene R. LaRoche
*Assistant Examiner*—Seung Ham
*Attorney, Agent, or Firm*—H. Gibner Lehmann; K. Gibner Lehmann

[57] ABSTRACT

An electric shaver having a handle, and a shaver head having a cutting blade, which is movably carried on the handle. A battery and electric motor are mounted in the handle. A drive member on the motor provides reciprocating movement to a pivotally mounted weight member in the shaver head. The arrangement is such that the weight member reciprocates back and forth at a high rate of speed and imparts reciprocatory, simple harmonic motion to the cutting blade carried by the shaver head. The cutting action is characterized by minimal movement in any direction except essentially linearly, substantially parallel to the blade. Improved shearing action of the hairs is realized, together with minimum tendency for pulling or tearing of the skin. Undesirable irritation, and the development of "nicks" are thereby significantly reduced.

21 Claims, 1 Drawing Sheet

Fig: 1
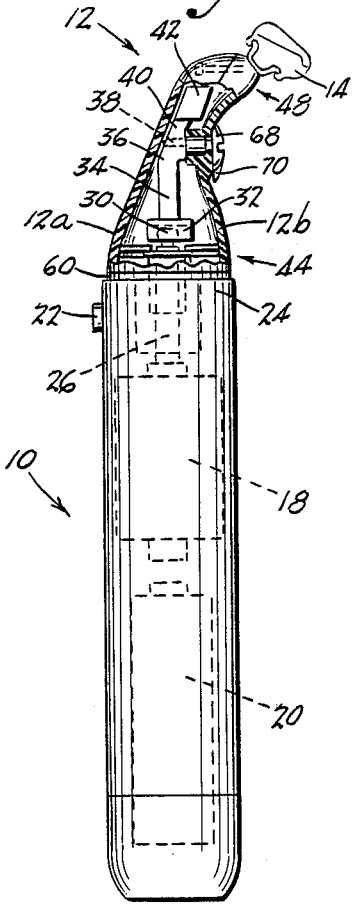
Fig: 3
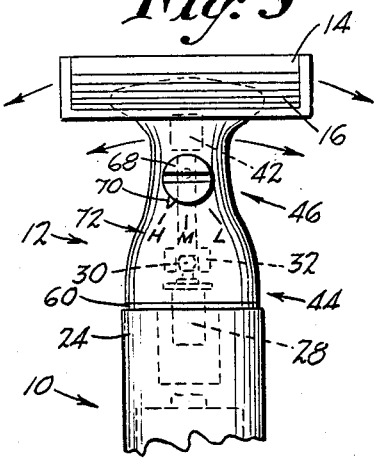
Fig: 2
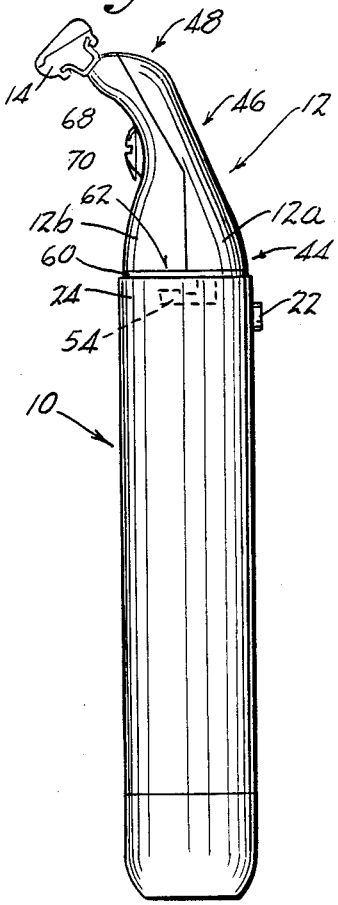
Fig: 4
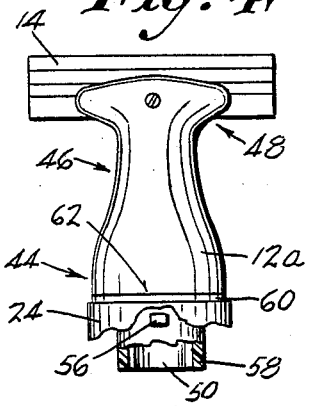
Fig: 5
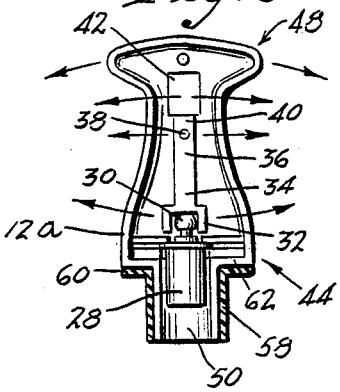
Fig: 6
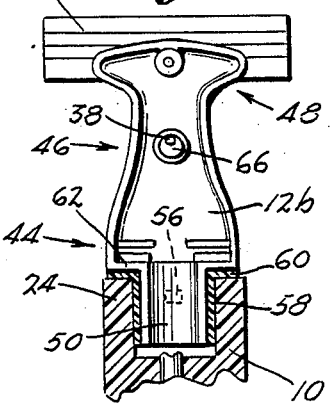
Fig: 8
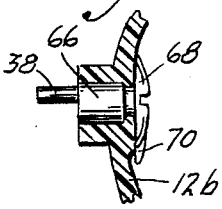
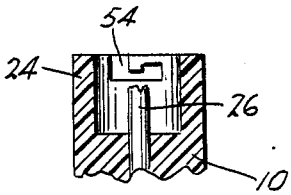
Fig: 7

LIVE-ACTION BLADE SHAVER

STATEMENT AS TO RIGHTS TO INVENTIONS MADE UNDER FEDERALLY-SPONSORED RESEARCH AND DEVELOPMENT

Research and development of the present invention and application have not been Federally-sponsored, and no rights are given under any Federal program.

BACKGROUND OF THE INVENTION

1. Field of the Invention

This invention relates to electric shavers, and more particularly to shavers having an oscillating cutting member, and having electric powered means for imparting longitudinal movements to the cutting member.

2. Description of the Related Art Including Information Disclosed Under 37 CFR §§1.97–1.99

A number of different arrangements have been proposed and produced in the past, involving vibration-producing mechanisms for shavers of the type employing replaceable razor blades. U.S. Pat. No. 3,636,627 discloses one construction which employs a battery-driven electric motor mounted in the handle of a shaver and which has an eccentric weight on the end of the motor shaft to produce a gyrating effect to the entire unit, including the cutting blade or edge of the shaver.

Another construction is illustrated in U.S. Pat. No. 3,611,568. This involves a somewhat similar design, in that an eccentric weight is carried on the end of the shaft of an electric motor disposed in the handle of the shaver.

Still other devices are illustrated in U.S. Pat. Nos. 2,319,815 and 2,609,602. In patent '815 there is disclosed a razor blade and carrier therefor, both of which are movably mounted with respect to the handle of the shaver, and positively power driven by a motor-driven gyratory shaft having a governor weight and imparting reverse movements to the assembly, via a direct drive through the shaft. Patent No. '602 relates to a construction wherein the blade is positively driven or reciprocated relative to the blade guard of the shaver.

U.S. Pat. No. 4,642,892 illustrates a number of shaver constructions involving reciprocation of a blade and its holder, by means of a direct drive. In the disclosed embodiments, an electric motor carries a bushing having an off-center shaft that cooperates with an apertured drive member, in order to effect a positive or driving reciprocation or oscillation of the blade.

While it is thought that some of the devices noted above operated in a satisfactory manner, it is believed that for the most part they generally suffered from a number of drawbacks. In cases where an eccentrically-mounted weight was employed, there was a tendency for the handle of the shaver to fully experience and dampen the vibration, as opposed to vibration of merely the blade. In addition, the use of eccentric weights gave rise to a gyrating type of movement, which is considered to have a deleterious effect on the shaving operation as well as on the skin of the user. Stated differently, with such constructions the blade was being forced edgewise into and withdrawn from the user's skin at a high rate of speed, typically at least one or two thousand times per second. There was thus a tendency for irritation to develop unless the magnitude of the vibrations was reduced to a very low value.

Where, in the prior art, reliance was had on relative movement between the blade and its holder, the tendency for lather and soap to penetrate the sliding surfaces and ultimately dry and harden, impaired the subsequent oscillatory movements of the blade.

Finally, most of the devices noted above were quite complicated, some involving multiple gear trains and drive shafts, and others having numerous components that were expensive to fabricate and difficult to assemble. Overall manufacturing cost thus made many of these devices unsuitable for the marketplace, and it is believed that the lack of acceptance of such devices is indicative of the drawbacks just mentioned.

SUMMARY OF THE INVENTION

The above disadvantages and drawbacks of prior shavers are obviated by the present invention which has for one object the provision of a novel and improved wet-blade shaver which is particularly simple in its construction, low in cost, and especially reliable in operation over a long period of use and in the absence of periodic clean-ups.

Another object of the invention is to provide an improved shaver as above set forth, wherein the blade is non-clogging, i.e. any collection of soap, hair, etc. at the blade will not impair its reciprocation, and wherein the blade has an essentially perfectly straight-line reciprocatory movement characterized by simple harmonic motion of the cutting edge.

Yet another object of the invention is to provide an improved shaver of the kind indicated, wherein there is achieved a significantly improved shaving capability, characterized by a minimum of undesirable pull of the whiskers and skin, resulting in less irritation and nicks than in devices heretofore known.

A still further object of the invention is to provide an improved shaver as above characterized, wherein an improved shearing action is had, to facilitate the clean cut-off of the whiskers without any chopping or pulling.

Still another object of the invention is to provide an improved shaver in accordance with the foregoing, wherein no bearings or other parts of the vibratory mechanism are exposed, thereby eliminating possible entry of soap, water, hair particles and other debris associated with such shavers from the interior of the mechanism and possibly causing damage to the various parts thereof Yet another object of the invention is to provide an improved shaver as above set forth, wherein the cutting blade is uniformly and easily held against the skin, thereby eliminating any tendency for it to bounce off during shaving Stated differently, there is virtually no vibratory motion of the blade in directions perpendicular to or transverse to the plane of the skin; nor is there any significant vibratory or gyratory motion in a direction along the axis of the handle. As a result, with the present design virtually all motion is in a direction essentially parallel to the cutting edge of the blade of the shaver, resulting in a maximum shearing effect and a minimum scraping of the cutting edge against the hair and skin and elimination of resultant undesirable skin tearing or "nicks".

The above objects are accomplished by the provision of an electric shaver comprising a handle, a shaver head having a cutting blade, novel attachment means for movably mounting the shaver head with its cutting blade on the handle, an electric motor in the handle, having a driving member, a weight member in the shaver head, having journal means that mount it relatively high in the head for oscillating movement therein, and drive means for imparting pure harmonic movements to the weight member in response to movement of said driving member which is powered by the motor. The arrangement is such that the motion imparted by the electric motor to the blade holder and blade carried thereby is characterized by essentially straight-line movement, lengthwise of the blade's cutting edge. The blade movement is not relative to its holder, but instead is concurrent with the holder, thereby obviating blade-clogging. In consequence, as noted above, improved cutting of the hair is had.

Other features and advantages will hereinafter appear.

BRIEF DESCRIPTION OF THE DRAWINGS

FIG. 1 is a view, partly in side elevation and partly in vertical section, of the improved shaver of the present invention, illustrating the drive connection between an electric motor carried by the shaver handle and the shaver blade mounting assemblage, and also illustrating an adjustment mechanism for varying the amount of vibration imparted to the mounting assemblage and blade.

FIG. 2 is a right side elevation of the shaver of FIG. 1.

FIG. 3 is a fragmentary front elevation of the shaver of FIGS. 1 and 2, illustrating calibrating indicia for the adjustment mechanism of the shaver.

FIG. 4 is a view, partly in rear elevation and partly in axial section, of the shaver of FIGS. 1–3.

FIG. 5 is a front elevation of one part of the shaving head of the shaver of FIGS. 1–4.

FIG. 6 is a view, partly in rear elevation and partly in axial section, of the other part of the shaving head of the shaver of FIGS. 1–5, and showing the resilient connection between the head and the shaver handle.

FIG. 7 is a fragmentary axial section of the upper portion of the shaver handle, showing a bayonet slot by which the head is held captive while permitting a resilient bushing to restrain the shaver head on the handle, and FIG. 8 is a fragmentary section of a pivot mounting for the lever that carries the weight member in the shaver head, and which comprises a member having a slotted head and an eccentric pivot post for mounting the lever.

DESCRIPTION OF THE PREFERRED EMBODIMENT

Referring to the figures, the improved live-action blade shaver of the invention comprises a handle 10 on which there is mounted a shaver head 12, the latter having a known commercially available safety-shaving blade-holder assemblage 14 including a safety razor blade 16. The blade-holder assemblage 14 is of the type adapted to receive a fresh blade 16 longitudinally from a magazine supply of the same (not shown) and to simultaneously eject a used blade 16, all as is well known in the art.

The shaver head 12 can be constituted of two mating parts 12*a* and 12*b*.

In accordance with the present invention the shaver head 12 and blade-holder assemblage 14 including the blade 16 are rigid with one another, and the assemblage is floating with respect to the shaver handle. The assemblage of blade 16 and blade holder 14 and shaver head 12 has imparted to it, in an extremely simple manner, a unique electric-powered oscillatory movement with respect to the handle 10 whereby the use of the shaver, i.e. the shaving off of hairs, is greatly facilitated. As provided by the invention, not only is the blade 16 subjected to an oscillatory longitudinal movement with respect to the handle 10, but the blade-holder assemblage 14 and the shaver head 12 are as well subjected to such oscillatory movement with respect to the handle. Stated differently, the shaving head is an inertia powered or inertia activated floating head having solely bi-directional movement. By virtue of this novel relationship, a simplified structure can be employed in the shaver, reducing costs while at the same time providing an improved shaving result.

The shave is characterized by a clean shear of the hair or whiskers, as opposed to a chopping action by the blade on the skin and whiskers.

The movement of the cutting blade and blade holder assemblage is essentially completely longitudinal with respect to the cutting edge of the blade 16, and is characterized by simple harmonic motion. Movement of the blade 16 and holder 14 in directions other than along the cutting edge of the blade is minimized, which has the desired effect of reducing any tendency for the blade to sequentially bounce off of and be re-applied onto the skin surface, as is the case with most prior shaver designs of the type employing eccentric centrifugal weights mounted in shaver handles. In contrast to the devices of the prior art, the effect of the oscillating weight in the head 12 is to move the head 12, blade-holder assemblage 14 and cutting blade 16 bi-directionally, that is, to cause them to oscillate in an essentially straight line, longitudinal of the cutting edge of the blade.

Referring to FIGS. 1 and 3, the handle 10 contains a small electric motor 18 and a single dry cell battery 20. The energy from the battery 20 can be switched to and from the motor 18 in any suitable manner as by means of a manually operable switch (not shown) having a button 22 located in the upper rim portion 24 of the handle.

The motor 18 has a driving member or shaft 26 that slidably telescopically fits into a coupling collar 28 with a spline connection (not shown) so as to transfer drive to the collar. The collar 28 has an eccentrically-mounted ball portion or post 30 which slidably fits into a socket portion 32 of a driven arm 34 of an oscillating lever 36 carried by a pivot pin 38 rigid in the shaver head 12. By such arrangement, energization of the motor 18 from the battery 20 will drivingly turn the collar 28 whereby the ball portion 30 thereof will effect rapid oscillation of the lever 36.

At the other or free arm 40 of the lever 36 there is carried a weight 42, which according to the invention is disposed relatively high in the shaver head 12. The shaver head 12 is seen to have a mounting portion 44, a reduced-diameter neck portion 46 and a blade-assemblage mount portion 48, and it will be seen that the weight 42 is disposed at a level which is located mostly above the neck portion 46 of the shaver head and between said neck portion and the cutting blade 16.

Further, in accordance with the invention, the shaver head 12 is non-rigidly or movably mounted on the handle 10 while being resiliently restrained and held captive thereon. To accomplish this, the shaver head 12 is provided with a hollow mounting boss 50 that is telescopically inserted and has predetermined clearance in the upper rim portion 24 of the handle 10. Bayonet slots 54 inside the handle portion 24 and bayonet lugs 56 on opposite sides of the mounting boss 50 cooperate to releasably hold the shaver head 12 captive on the handle 10, yet with sufficient looseness to avoid a rigid connection. Further, a resilient bushing 58 fits between the boss 50 and handle portion 24. The bushing 58 has a flange 60 which can be integral therewith, and which fits between the top rim of the handle 10 and a shoulder 62 on the shaver head 12. The bushing 58 can be of sponge rubber or plastic material; it enables the shaver head 12 to have easy movement within limits, independently of the handle 10.

The invention thus effects structure by which the shaver head 12, blade-holder assemblage 14 and blade 16 will all oscillate in unison and with respect to the handle 10, which latter is being held in the hand of the user. As the weighted lever 36 rapidly oscillates, it imparts oscillatory forces to the shaver head 12 carrying the holder 14 and blade 16, causing these to have considerable, forceful movements longitudinally of the blade, while the handle 10 remains quite stationary. We have found that with this organization an extremely smooth and comfortable wet shave can be had, without pull of the blade against the skin, inasmuch as the blade is rapidly oscillating in longitudinal directions, back and forth, while the handle is held steady in the hand with a minimum of vibration being felt by the user.

The extent of oscillation of the shaver head 12 and blade 16 with respect to the handle 10 can be controlled, according to the invention, to accommodate light, medium or heavy beards. To accomplish this, the pivot pin 38 for the lever 36 can be eccentrically mounted and adjustable in an arc.

As seen in FIG. 8, the pin 38 is eccentrically carried by a stub shaft 66 passing through the neck portion 46 of the shaver head part **12*b* and having a slotted head 68 and pointer 70 at its exterior. The pointer 70 is referrable to indicia 72 in the form of the letters "H", "M" and "L" on the exterior of the shaver head. Turning of the stub shaft 66 can be effected by a thin coin or screw driver. The shaft 66 is frictionally held firmly by having a press fit in the shaver head, and is retained in position by means of an annular groove in the shaft under the head 68, which accommodates an annular bead in the hole of the shaver head part. In effect, the stud 66 with pivot pin 38 constitute a manually-engageable means for changing the location of the path of movement of the weight member 42 in the shaver head part 12*b*. Turning of the stud 66 shifts the path of movement of the weight member 42 axially with respect to the handle 10** of the shaver.

The driving connection between the ball portion 30 of the coupling collar 28 and the driven arm 34 of the lever 36 provides the necessary clearance to permit the eccentric pivot pin 38 to shift through its full arcuate travel, shown as approximately 90°.

The unlabelled arrows in FIGS. 3 and 5 depict the movements of the shaver head and related parts as being essentially planar, such movements occurring in the plane of the paper, and being representative of simple harmonic motion.

An important feature of the invention resides in the structure by which the cutting edge of the blade is made to have longitudinal reciprocative movements without requiring bearing or other sliding surfaces which might become contaminated and eventually encrusted with hard soap particles, hair particles, etc. Such a circumstance, which occurs with prior vibrating-blade shavers can greatly impair the movements of the cutting edge and invention the blade 16 and holder assemblage 14 together with the shaver head 12 all vibrate as a unit or unitary structure which is associated with a restraining resilient means in the form of the bushing 58. The unique arrangement thus provided by the applicants has distinct advantages over prior vibratory blade shavers.

An important feature of the present improved oscillatory shaver resides in the ease with which the shaving can be accomplished. The shaver is held only lightly against the skin and then drawn gently downward in a constant wiping stroke, much like a gliding action. The blade glides along the skin, and the user does not need to employ an intermittent, short or choppy movement. We have found that the unique forces which act on the blade while the handle is held steady and firm, are instrumental in attaining the improved, easy shaving action.

It will now be seen from the foregoing that we have provided an extremely simple, electrically-powered wet blade shaver wherein the blade and its holder assemblage have a longitudinal oscillatory movement with respect to the shaver handle. The concurrent movement of the blade 16 and the blade-holder assemblage 14 and shaver head 12 does not materially hinder the blade oscillations and impair the smooth shaving action, and we attribute this to the wetted surface of the skin which is being shaved, which limits any tendency for blade drag. However, we have found that, with the present improved blade action, a satisfactory dry shave can also be had.

Simple and effective means are provided to adjust for the degree of vibration of the shaving head and blade, to suit different beard conditions.

Variations and modifications are possible without departing from the spirit of the invention.

Each and every one of the appended claims defines an aspect of the invention which is separate and distinct from all others, and accordingly it is intended that each claim be treated as such when examined in the light of the prior art devices in any determination of novelty or validity.

We claim:

1. An electric shaver comprising, in combination:

(a) a handle, (b) a shaver head having a cutting blade, (c) attachment means for movably mounting the shaver head on the handle, (d) an electric motor in said handle, having a driving member, (e) a weight member, (f) journal means mounting said weight member in the shaver head for oscillating movement therein, and (g) drive means for imparting movement to the weight member in response to movement of said driving member.

2. An electric shaver as set forth in claim 1, wherein:

(a) said driving member of the motor is a rotary shaft, (b) said drive means imparting oscillatory movement to the weight member in response to turning movement of said shaft.

3. An electric shaver as set forth in claim 1, and further including:

(a) a resilient bush means engaged with said attachment means, to yieldably restrain said shaver head against unrestricted movement on said handle.

4. An electric shaver as set forth in claim 3, wherein:

(a) said attachment means includes a bayonet slot connection between said handle and shaver head.

5. An electric shaver as set forth in claim 4, wherein:
(a) said attachment means includes telescoping portions of said handle and shaver head.

6. An electric shaver as set forth in claim 1, wherein:
(a) said shaver head has a reduced-width neck portion disposed intermediate said attachment mounting means and said cutting blade,
(b) said weight member being disposed at a location between said neck portion and said cutting blade.

7. An electric shaver as set forth in claim 1, wherein:
(a) said journal means includes a lever and eccentrically mounted pivot means movably mounting the lever on the shaver head, and
(b) means for effecting manual rotary adjustment of the eccentrically mounted pivot means, whereby the position of the lever and the weight member can be adjusted within the head, to provide different degrees of movement of the head and blade.

8. An electric shaver as set forth in claim 1, wherein:
(a) said drive means moves said weight member with simple harmonic motion.

9. An electric shaver as set forth in claim 8, wherein:
(a) said drive means moves the weight member in directions substantially in a straight line substantially parallel to the edge of the cutting blade.

10. An electric shaver as set forth in claim 7, wherein:
(a) the weight member is located between the pivot means and the cutting blade.

11. An electric shaver as set forth in claim 7, wherein:
(a) the drive means comprises a socket on one end of the lever,
(b) said drive means further comprising an eccentric post carried by the driving member of the electric motor, said eccentric post being receivable in the socket.

12. An electric shaver comprising, in combination:
(a) a handle,
(b) a shaver head and means for movably mounting the head on said handle, having a cutting blade, and having a reduced width neck portion disposed intermediate said mounting means and cutting blade,
(c) a weight member mounted for oscillatory movement in the shaver head at a location between said neck portion and said cutting blade,
(d) an electric motor in said handle, having a driving member, and
(e) drive means for imparting movement to the weight member in response to movement of said driving member.

13. An electric shaver as set forth in claim 12, wherein:
(a) said drive means includes a lever and pivot disposed in said reduced-width neck portion.

14. An electric shaver as set forth in claim 13, and further including:
(a) means eccentrically mounting said pivot in said neck portion.

15. An electric shaver as set forth in claim 14, and further including:
(a) means for effecting manual rotary adjustment of said eccentrically mounted pivot.

16. An electric shaver as set forth in claim 15, wherein:
(a) said pivot comprises a stud turnably mounted in said neck portion,
(b) said adjustment means comprising a slotted head on said stud.

17. An electric shaver as set forth in claim 16, wherein:
(a) said stud is frictionally held by the neck portion in different adjusted rotary positions.

18. An electric shaver as set forth in claim 15, and further including:
(a) indicia on said shaver head, for indicating different adjusted rotary positions of said pivot.

19. An electric shaver comprising, in combination:
(a) a handle,
(b) a shaver head having a cutting blade,
(c) attachment means for mounting the shaver head on the handle,
(d) an electric motor in said handle, having a driving member,
(e) a lever mounted in the shaver head, siad lever having a fulcrum mounting means,
(f) a weight member mounted on said lever, said weight member being movable along a predetermined path in said shaver head,
(g) drive means for imparting movement to the lever in response to movement of said driving member, and
(h) manually-engageable means acting on the fulcrum mounting means of the lever, for changing the location of the fulcrum mounting means in the shaver head.

20. An electric shaver as set forth in claim 19, wherein:
(a) the manually-engageable means shifts the fulcrum mounting means in a direction axially with respect to the handle of the shaver.

21. An electric shaver comprising, in combination:
(a) a handle and a neck extending from one end of the handle,
(b) a shaver blade mount on said neck, said blade mount and neck being rigidly affixed to each other against relative movement,
(c) a cutting blade normally fixedly carried by the blade mount to move therewith and with said neck,
(d) attachment means for movably mounting said neck on the handle,
(e) an electric motor in said handle, having a driving member,
(f) drive means connected with said movably-mounted neck and with said driving member, for imparting oscillatory, essentially straight-line movement to the neck, the shaver blade mount and the blade carried thereby with respect to said handle in a direction longitudinally of the blade and in response to powered movement of said driving member,
(g) said attachment means including telescoping portions of said handle and shaver blade mount.

* * * * *